US006581552B2

(12) United States Patent
Kreuter

(10) Patent No.: US 6,581,552 B2
(45) Date of Patent: Jun. 24, 2003

(54) APPARATUS FOR CHANGING THE COMPRESSION OF A CYLINDER OF A PISTON ENGINE

(75) Inventor: Peter Kreuter, Aachen (DE)

(73) Assignee: Meta Motoren-und Energie-Technik GmbH (DE)

( * ) Notice: Subject to any disclaimer, the term of this patent is extended or adjusted under 35 U.S.C. 154(b) by 0 days.

(21) Appl. No.: 10/048,722

(22) PCT Filed: May 23, 2001

(86) PCT No.: PCT/EP01/05956

§ 371 (c)(1),
(2), (4) Date: Jan. 29, 2002

(87) PCT Pub. No.: WO01/92700

PCT Pub. Date: Dec. 6, 2001

(65) Prior Publication Data

US 2003/0075125 A1 Apr. 24, 2003

(30) Foreign Application Priority Data

May 29, 2000 (DE) ..... 100 26 634
Nov. 23, 2000 (DE) ..... 100 58 206

(51) Int. Cl.[7] ..... F02B 75/06
(52) U.S. Cl. ..... 123/48 R; 123/48 B; 123/197.3
(58) Field of Search ..... 123/48 B, 197.4, 123/197.3, 48 R

(56) References Cited

U.S. PATENT DOCUMENTS 1,518,334 A * 12/1924 McMaster ..... 123/197.4
2,904,023 A * 9/1959 Roth ..... 123/48 R
4,203,406 A * 5/1980 Smith ..... 123/197.2
4,690,113 A * 9/1987 Deland ..... 123/197.4
4,721,073 A 1/1988 Naruoka et al.
5,239,958 A * 8/1993 Booher ..... 123/197.3
5,245,962 A * 9/1993 Routery ..... 123/197.3
5,724,935 A * 3/1998 Routery ..... 123/48 B
5,979,375 A * 11/1999 Ballardini ..... 123/48 B
6,202,622 B1 * 3/2001 Raquiza, Jr. ..... 123/197.4

FOREIGN PATENT DOCUMENTS

| | | |
|---|---|---|
| DE | 3818357 | 3/1989 |
| DE | 3825369 | 5/1989 |
| DE | 4040274 | 6/1992 |
| DE | 348555 | 5/1999 |
| DE | 19757871 | 7/1999 |
| EP | 0434646 A1 | 6/1991 |
| GB | 473887 | 10/1937 |
| WO | WO 00/08325 | 2/2000 |

* cited by examiner

*Primary Examiner*—Noah P. Kamen
*Assistant Examiner*—Jason Benton
(74) *Attorney, Agent, or Firm*—R W Becker & Associates; R W Becker

(57) ABSTRACT

An apparatus for changing the compression in a cylinder of a piston engine is provided that includes an eccentric for eccentrically mounting the one end of the piston rod to the piston, an eccentric swing component secured to the eccentric, and a linkage assembly for controlling the swing movement of the eccentric swing component to effect a corresponding change in the compression in the cylinder. The linkage assembly includes a position coupling for guiding the eccentric swing component to swing through a predetermined swing movement during stroke movement of the piston. A guide assembly guides the eccentric swing component or the position coupling along a predetermined path during its respective movement during a piston stroke.

15 Claims, 13 Drawing Sheets

APPARATUS FOR CHANGING THE COMPRESSION OF A CYLINDER OF A PISTON ENGINE

BACKGROUND OF THE INVENTION

The present invention relates to an apparatus for changing the compression of a cylinder of a piston engine.

Ever since there have been reciprocating piston engines, the wish has been present to increase their compression—that is, to change the relationship of the volume of the combustion chamber in the bottom dead point of the piston stroke with respect to the volume of the combustion chamber in the top dead point of the piston stroke. In Otto engines, the maximum compression is principally dictated, during full loading, by the onset of the tendency to knock, such that, during partial loading or charging, a less fuel consuming operation having a higher compression is possible. In diesel motors, a particularly high compression during start-up is required so that, in normal operation, less fuel consuming and noise producing operation with lower compression can be possible.

SUMMARY OF THE INVENTION

In the publication EP 0434 646 A1, an apparatus is described in accordance with the principal concept of the enclosed main claim, in which the position coupling, which is connected in a position coupling manner with the eccentric swing component, is connected to a gear, which itself is coupled to a butterfly valve and a gas pedal in such a manner that the compression of the cylinders decreases if the butterfly valve is opened.

The present invention offers a solution to the challenge of providing an apparatus, which further develops the conventional state of the art apparatus so that the apparatus can be installed in a simple manner to meet the everyday requirements of a piston engine used in a commercial vehicle.

In accordance with the guide assembly of the present invention, the operation of the adjustment mechanism is stabilized so that a fluttering or an instability in the movement of the engine components is also avoided during a high rate of rotation and an excellent functional reliability and long operational life is achieved.

The dependent claims reveal further advantageous details of the inventive guide assembly.

The claims characterize the configurations of the apparatus of the present invention whose kinematic movement is especially advantageous.

In accordance with one claim, the apparatus of the present invention can be configured in a simple manner such that the compression of a plurality of cylinders of a piston engine can be simultaneously changed.

The claims characterize eccentric arrangements which are particularly kinematically advantageous.

In accordance with the features recited in one claim, the operational security of the apparatus of the present invention is further improved.

Another claim characterizes a particularly advantageous embodiment of a piston rod.

The invention is described hereinafter in an exemplary manner in connection with schematic drawings and with further details thereof being provided.

The dependent claims are directed toward advantageous further embodiments and modifications of the inventive apparatus.

BRIEF DESCRIPTION OF THE DRAWING

The invention is hereinafter described in connection with the schematic drawings in an exemplary manner and with further details being explained.

The drawings show.

DESCRIPTION OF PREFERRED EMBODIMENTS

Figure 1:
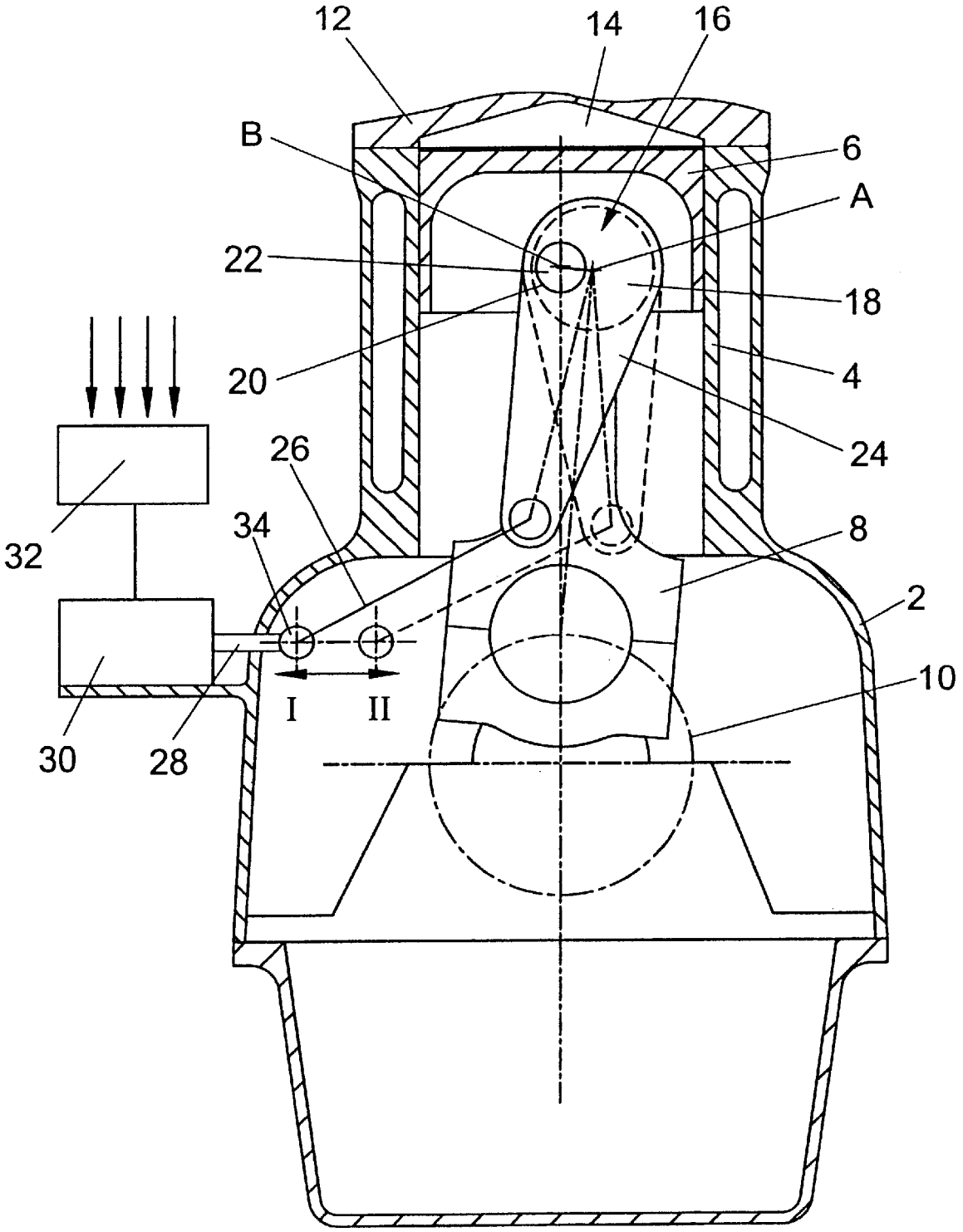
FIG. 1 is a schematic cross-sectional view through a cylinder of a piston engine.

As can be seen in FIG. 1, a combustion engine comprises a motor housing 2 with one or more cylinders 4 in which a piston 6 is disposed for movement therein. The piston 6 is connected via a piston rod 8 with a crankshaft 10 whose annular crankshaft movement path is shown in broken lines. A combustion chamber 14 above the piston is delimited by the piston 6, the cylinder 4, and a cylinder head 12.

The operation and function of such combustion engines, which can operate in remote starter or self-starter modes in accordance with a two-cycle process or a four-cycle process or another process, are conventionally known and are not further described herein.

In contrast to the usual combustion engine, the piston rod 8 is not positioned relative to the piston in a manner in which a piston rod eye receives in a concentric manner a piston pin secured to the piston but, rather, with the help of an eccentric generally designated as 16, which comprises a disk 18 rotatable around axis A disposed in the piston rod 8, which disk 18 has a bore 20 arranged eccentrically to the axis A, the piston rod 8 is secured to the piston by a piston bolt 22 secured to the piston for rotation about an axis B. The piston axis B, which is unchanging relative to the piston, is preferably disposed in the mid plane of the piston 6.

An eccentric swing component 24, which is respectively fixably or rotatably connected to the disk 18, has an end connected with a position coupling 26, which, in turn, is connected in a linked manner with a slide 28 whose position is adjustable by means of a drive unit 30 secured to the motor housing 2 operable to adjust the slide position in the direction shown by the double arrow shown in FIG. 1. A control device 32 is provided for controlling the drive unit 30, which, for example, can be an electric motor control device whose inputs 34 are connected to sensors for sensing the operational parameters of the motor or, respectively, of the entire motor vehicle, on the basis of which the control parametrics are calculated. The configuration and function of such motor control devices are conventionally known.

The arrangement of the eccentric swing component 24 is preferably such that it is disposed in the middle of the adjustment path of the slide 28, which is adjustably moveable in the directions indicated by the double arrow, at a location approximately vertically below this device, and the axis B is spaced, relative to the horizontal direction, from the axis A. The position coupling 26 is preferably so arranged that it is approximately in a horizontal position if the piston 6 is approximately halfway between the upper dead point and the lower dead point. The slide 28 is adjustable in a generally horizontal direction, so that the linkage connection between the slide 28 and the position coupling 26, which together form a position bearing 34, is correspondingly horizontally adjustably movable.

Figure 2:
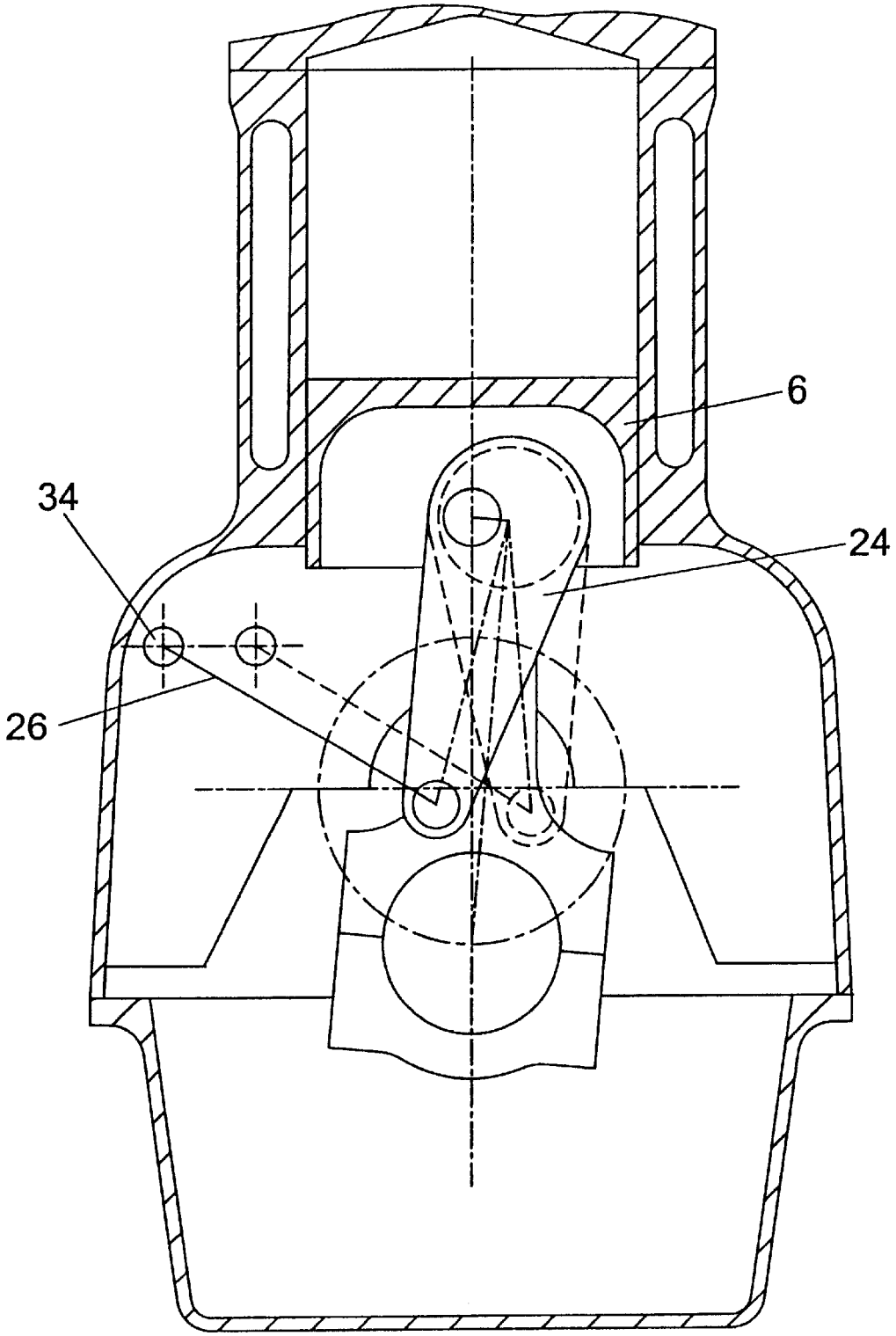
FIG. 2 shows the cylinder shown in FIG. 1 in another position of the piston.

FIG. 2 shows an arrangement of the bottom dead point position of the piston shown in FIG. 1.

Figure 3:
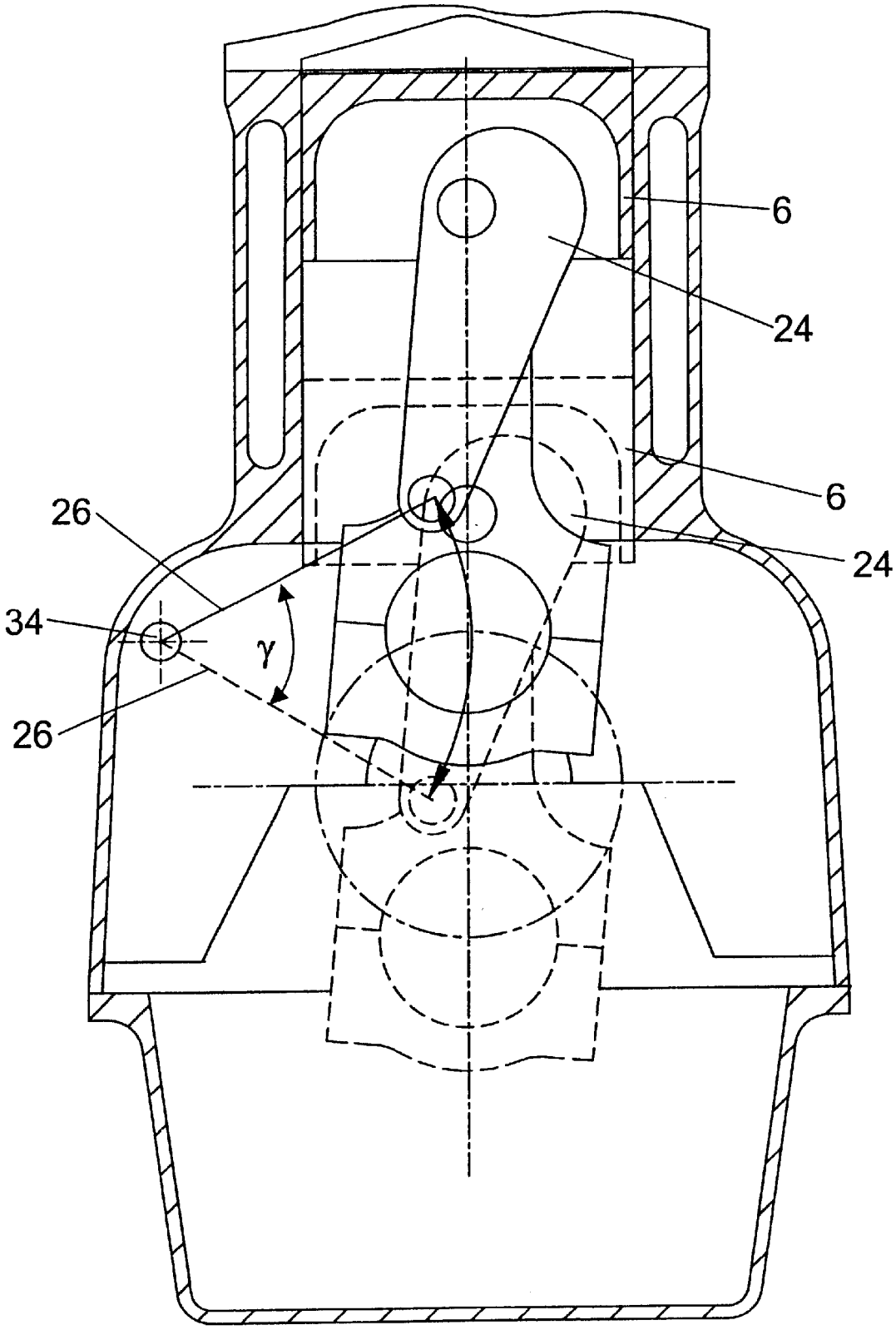
FIG. 3 shows the cylinder shown in FIG. 1 with two different piston positions.

FIG. 3 illustrates the swing movement which the position coupling 26 executes through an angle y, if the fixedly secured position bearing 34 in the piston 6 is moved back and forth between the top dead point and the bottom dead point. It is to be understood that, if the position coupling 26 is moved through angle y in the course of the piston stroke, the eccentric swing component 24 is likewise swung through a predetermined swing angle. In this manner, a relative movement occurs between the piston 6 and the piston rod 8, which, to be sure, changes the movement arrangement between the piston and the crankshaft, but, however, has no other impact, especially if the swing movement of the position coupling 26 throughout its entirety through the angle y is symmetric with the horizontal plane.

Figure 4:
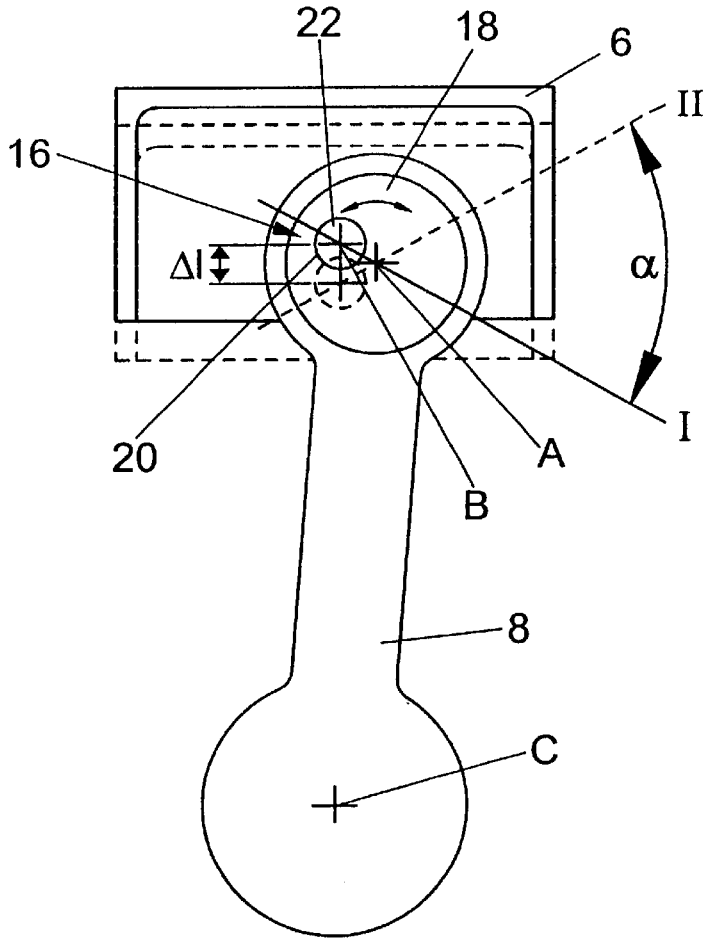
FIG. 4 shows a piston rod with a piston for explaining the operational manner of the invention.

With reference to FIG. 4 viewed in connection with FIG. 1, the function for adjusting the compression relationship is hereinafter explained.

In FIG. 4, in which, for the sake of clarity of the drawing, the eccentric swing component 24 has not been depicted, the left position of the adjustment bearing 34 shown in FIG. 1 is designated as I. As can be seen, the axis B is disposed, in this connection, to the upper left of the axis A. The distance between the axis A and the position axis C of the piston rod on the crankshaft 10 (FIG. 1)—that is, the effective piston rod length—is at a maximum in the position I; correspondingly, the compression relationship is at a maximum. If the adjustment bearing 34 is moved into the position II, the disk 18 is turned through an angle $\alpha$ in a counterclockwise direction into the position II, so that the axis B, as seen in FIG. 4, moves into a position to the lower left of the axis A and the distance between the axis B and axis C is at a minimum—that is, the compression relationship is correspondingly at a minimum.

In this manner, via an adjustment of the adjustment bearing 34 by the drive unit 30 as controlled by the control device 32, the compression of the cylinder and, thereby, of the combustion engine, can be changed in an expedient manner. It is to be understood that, in a multiple cylinder combustion engine, the aforedescribed arrangement can be advantageously provided for each respective cylinder.

Figure 5:
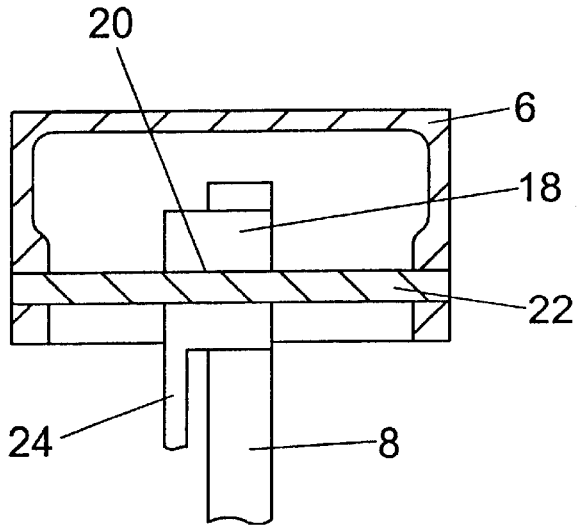
FIG. 5 shows a cross-sectional view through a piston taken along the mid plane thereof in which a piston bolt is disposed and FIG. 6 shows a view, similar to that of FIG. 1, of a modified embodiment of a piston engine.

FIG. 5 shows that the disk 18, which is disposed in the piston rod 8, is preferably formed as a unitary piece with the eccentric swing component 24, and the piston bolt 22 extends through the bore 20 which is eccentric to the axis A (FIG. 4).

By means of the apparatus of the present invention, the moveable mass of a combustion engine is, to be sure, somewhat enlarged; the components can, however, be configured of such a small mass that they do not substantially influence the rotational performance of the engine. Moreover, due to the capability to change the compression of the engine, reduction of the engine mass is possible.

The exemplary apparatus described herein can be changed in numerous ways, whereby the following descriptions of possibilities are provided only to illustrate the range of such possibilities.

The eccentric can be configured to directly support the piston bolt or, respectively, can be configured therewith as a unitary unit.

The drive unit 30 can be driven in an electric, hydraulic or pneumatic manner, or any other suitable drive manner. To ensure that the rotation position of the eccentric swing component 24 during the piston stroke remains unchanged, the eccentric swing component 24 can comprise, instead of the linkage connection to the position coupling 26, a pin on its end moveable vertically up and down in a guided manner in a guide component (not shown) with the guide component being adjustable by means of the drive unit 30 in a horizontal direction. In this manner, the position coupling 26 which moves correspondingly with the piston can be omitted.

Alternatively, instead of the displacement of the adjustment bearing 34, the length of the position coupling 26 can be changed by configuring the position coupling to be telescopic and by using a hydraulic drive or a threaded drive piece which is driven by an electric motor drive to effect counter displacement of the telescoping part.

In a modified embodiment, the eccentric can be turned by a hydraulic or electric component which is directly integrated into the piston rod.

Figure 6:
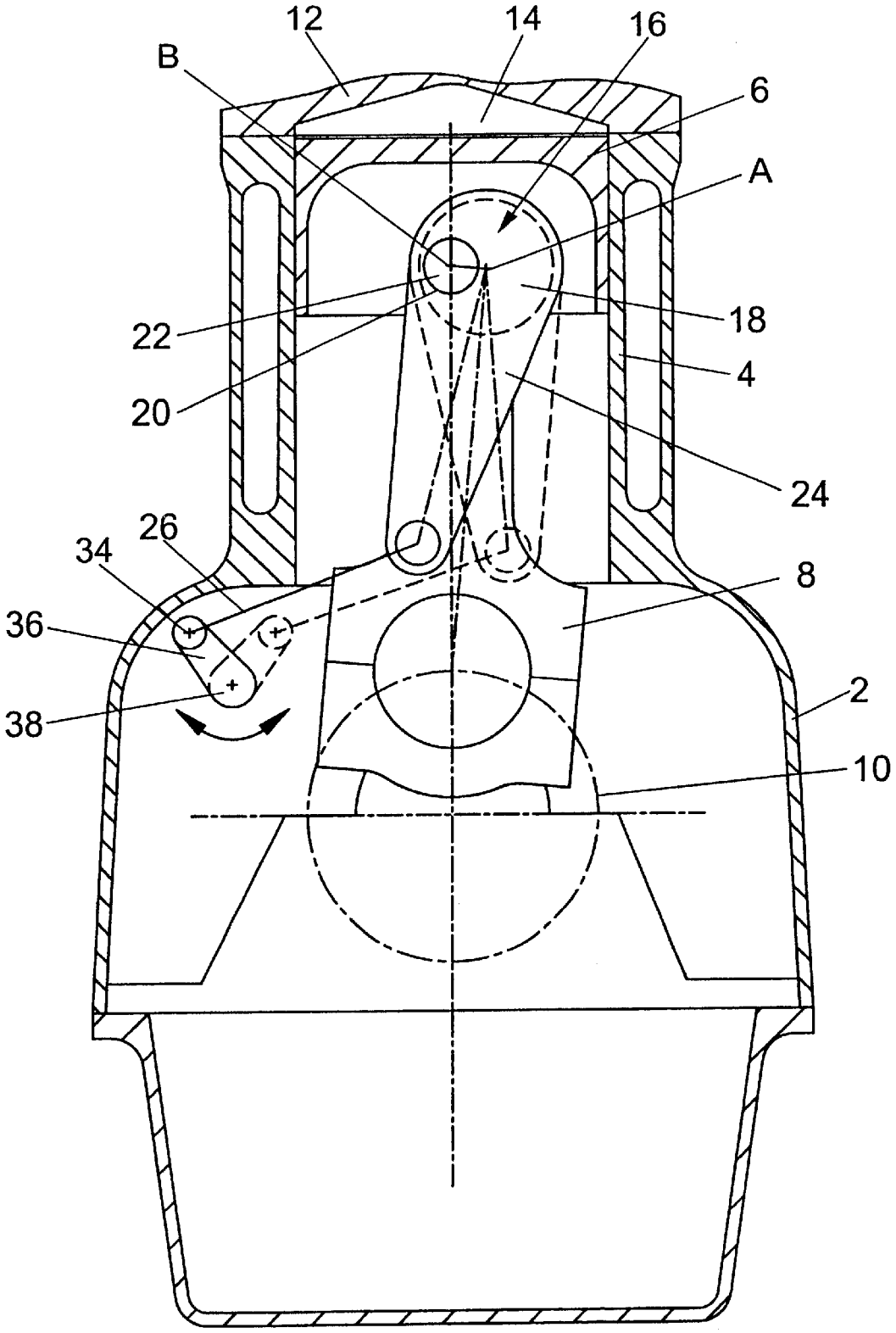

FIG. 6 shows an embodiment of the combustion engine, which differs from that shown in FIG. 1 in that the adjustment bearing is arranged on the end of an arm 36, which is fixably secured to a shaft 38, which itself is rotatably driven by a drive (not illustrated) to effect a change in the compression. The shaft 38 can extend through an entire cylinder bank of a multi-cylinder motor, whereby each piston rod of the individual cylinders carries an eccentric swing component and all of the eccentric swing components are arranged such that they are adjusted in a simultaneous manner by the arm connected to the shaft 38. In this manner, a simultaneous adjustment capability for adjusting the compression of several cylinders by means of a single drive can be achieved.

Figure 7:
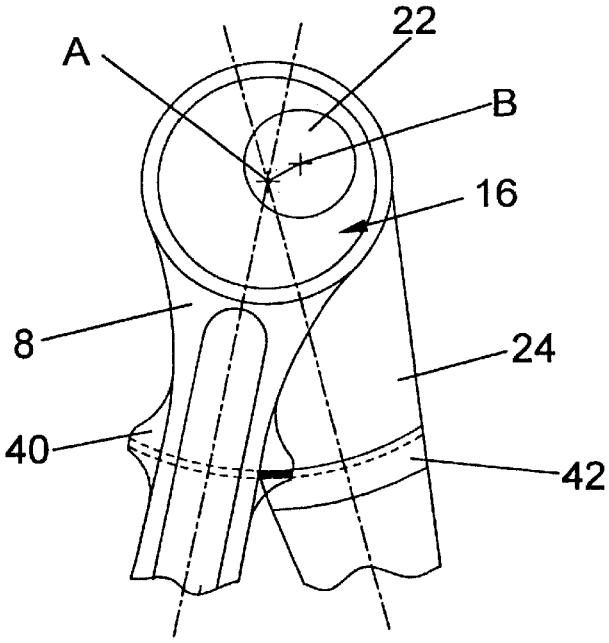
FIG. 7 is a detailed view of a piston rod with an eccentric and an eccentric swing component as viewed from the side of the piston rod.

As seen in FIG. 7, the eccentric swing component 24 includes a slide guide component 40 which extends to the piston rod 8, the slide guide component 40 having a guide groove 42 disposed therein. The slide guide component 40 and the guide groove 42 extend concentrically with respect to the rotation axis A such that they are swingable about the eccentric 16 and, thereby, permit movement of the eccentric 16 and, consequently, of the eccentric swing component 24, relative to the piston rod 8. The guide arrangement comprised by the slide guide component 40 and the guide slot 42 ensures guided engagement of the eccentric swing component 24 and the piston rod 8 throughout the movement of the eccentric swing component 24 through its entire range of swing movement relative to the piston rod 8 such that a flutter movement of the eccentric swing component 24 is prevented and any tolerance deviations which may occur can be taken into account. It is to be understood that different possibilities exist in configuring the mutually engaged sectional portions of the slide guide component 40 and the guide slot 42. Moreover, the guide slot 42 can be configured on the eccentric swing component 24 and the slide guide component 40 on the piston rod 8.

Figure 8:
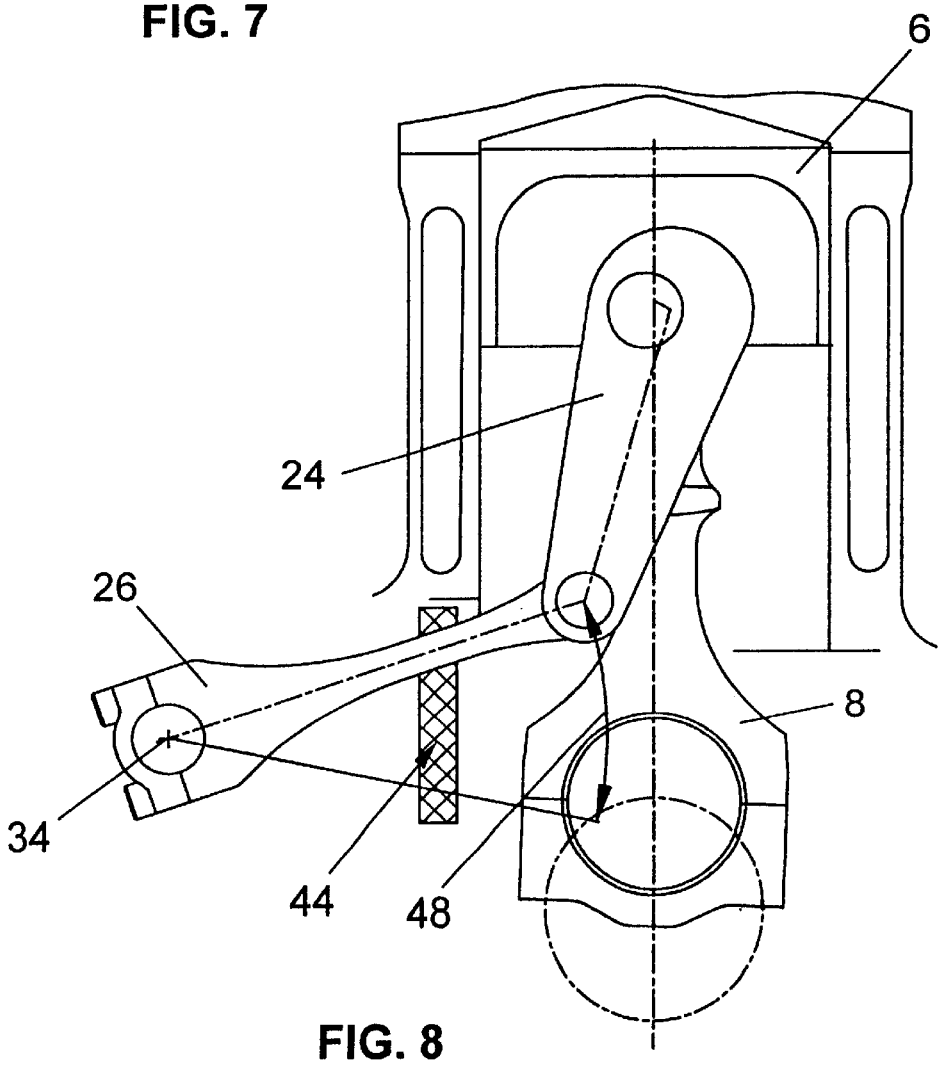
FIG. 8 is a view similar to the view in FIG. 6 with a guide for a position coupling.

FIG. 8 shows another embodiment for guiding the adjustment mechanism. In this embodiment, a guide assembly 44 is formed on the engine housing which guides the movement of the position coupling 26 during the upward and downward movement of the piston 6. The guide assembly 44 is configured, for example, with a slot in which the position coupling 26 is displaceably guided. The arcuate segment 48 represents the movement path of the end of the position coupling 26 which is connected to the eccentric during movement relative to the fixably located adjustment bearing 34. Also, with the guide assembly 44, the adjustment mechanism is stabilized and a fluttering in spite of any tolerance allowance is avoided.

Figure 9:
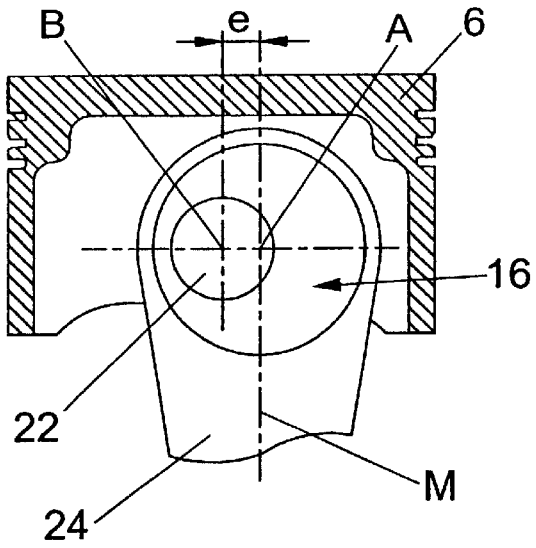
FIGS. 9–12 are schematic views for explaining advantageous arrangements of the eccentric and the eccentric swing component relative to the piston.

FIG. 9 shows an advantageous positioning of the eccentric mechanism relative to the piston 6. In many configurations, it is advantageous if the piston bolt 22 is arranged such that its axis B is offset relative to the mid plane M of the piston 6; in the illustrated example, this offset is designated by a spacing e. This has the advantage that the piston does not have a tendency toward tipping or rattling. The eccentric 16, which is pivotably supported in the piston rod and pivotable about the axis A, is arranged such that the axis A is offset relative to the axis B in an opposite direction as viewed with respect to the mid plane M. In this manner, a better usage of the space in the piston 6 is achieved. In the illustrated example, the pivot axis A is disposed approximately in the mid plane M of the piston 6. This is, however, not strictly necessary.

Figure 10:
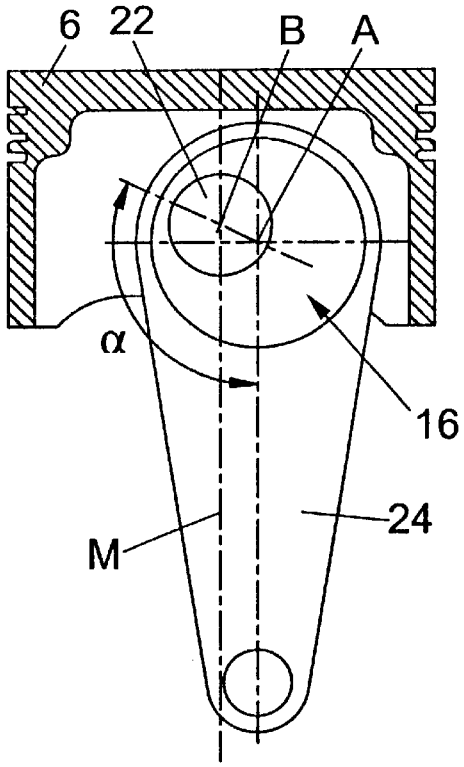

FIG. 10 shows a further advantageous arrangement of the eccentric mechanism within the piston 6, which can be used in combination with the arrangement in accordance with FIG. 9. As can be directly seen in FIG. 10, the axis A of the position of the piston rod (not illustrated) on the eccentric 16, when the eccentric swing component 24 is parallel to the mid plane M of the piston 6, is not only offset relative to the axis B of the piston bolt 22, as viewed with respect to the mid plane M of the piston, but is also offset in the direction toward the crankshaft (in the downward direction as seen in FIG. 5). In the illustrated example, an angle $\alpha$ formed between the line which connects the two turning midpoints A and B and the direction parallel to the piston mid plane M is approximately 115°. Moreover, in the illustrated example, the axis B is approximately in the piston mid plane. This is not strictly necessary; the axis B can also, in a manner similar to that shown in FIG. 8, be arranged outside of the mid plane M.

Figure 11:
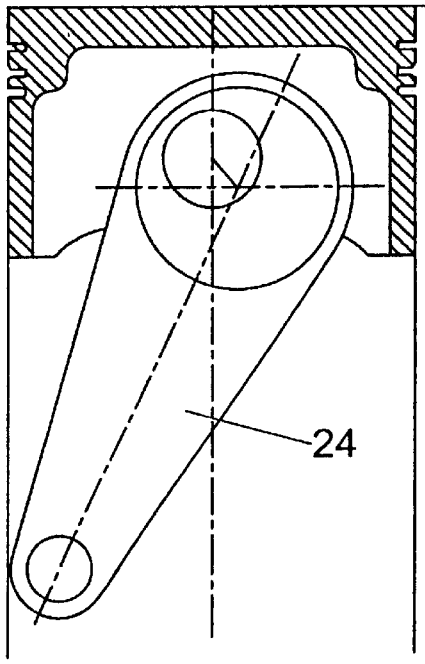
Figure 12:
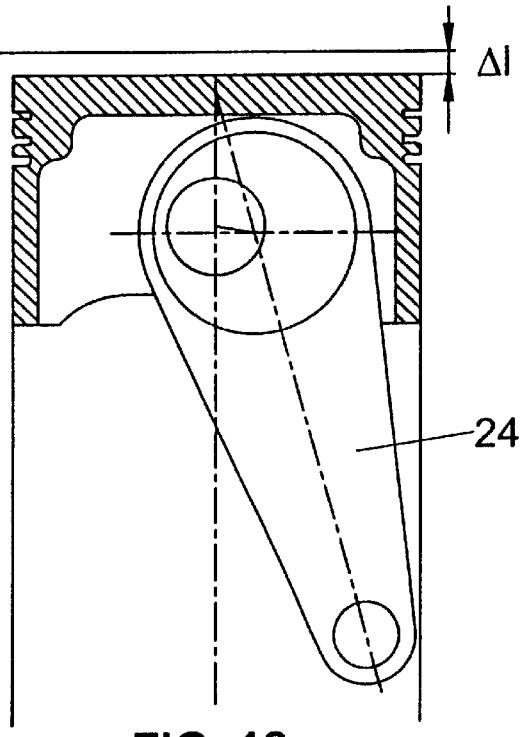

With the arrangement in accordance with FIG. 10, the available component installation space is optimally exploited in a piston and, especially, a piston with a deep piston bottom. As a result of the swing movement of the eccentric swing component 24 off center to the piston in connection with an adjustment of the compression or, respectively, of the effective piston rod length, the space relationship interiorly and underneath the piston is non-symmetrical. FIG. 11 shows the position of the eccentric swing component 24 during a maximum swing movement toward the left (in a clockwise direction)—that is, for a maximum effective length of the piston rod (not shown) and, thus, a maximum compression. FIG. 12 shows the position of the eccentric swing component 24 during a maximum swing movement toward the right (in a counter-clockwise direction) for a minimal compression. $\Delta 1$ shows the effective piston rod length change between the minimum and maximum compressions. As a result of the position of the axes A and B within the piston 6, as explained in connection with FIG. 9, the installation space for components is optimally exploited, as can be directly seen, for the reason that the eccentric and, thus, as well, the piston rod within the piston moves only a small displacement distance outwardly during swing movement in the counter-clockwise direction due to the available small swing angle, whereby the distance between the piston bolt and the piston bottom can be relatively small. An important advantage, which can be achieved by selection of the angle $\alpha$ to be greater than 90°, lies in the fact that the axis A is spaced from the piston bolt.

Figure 13:
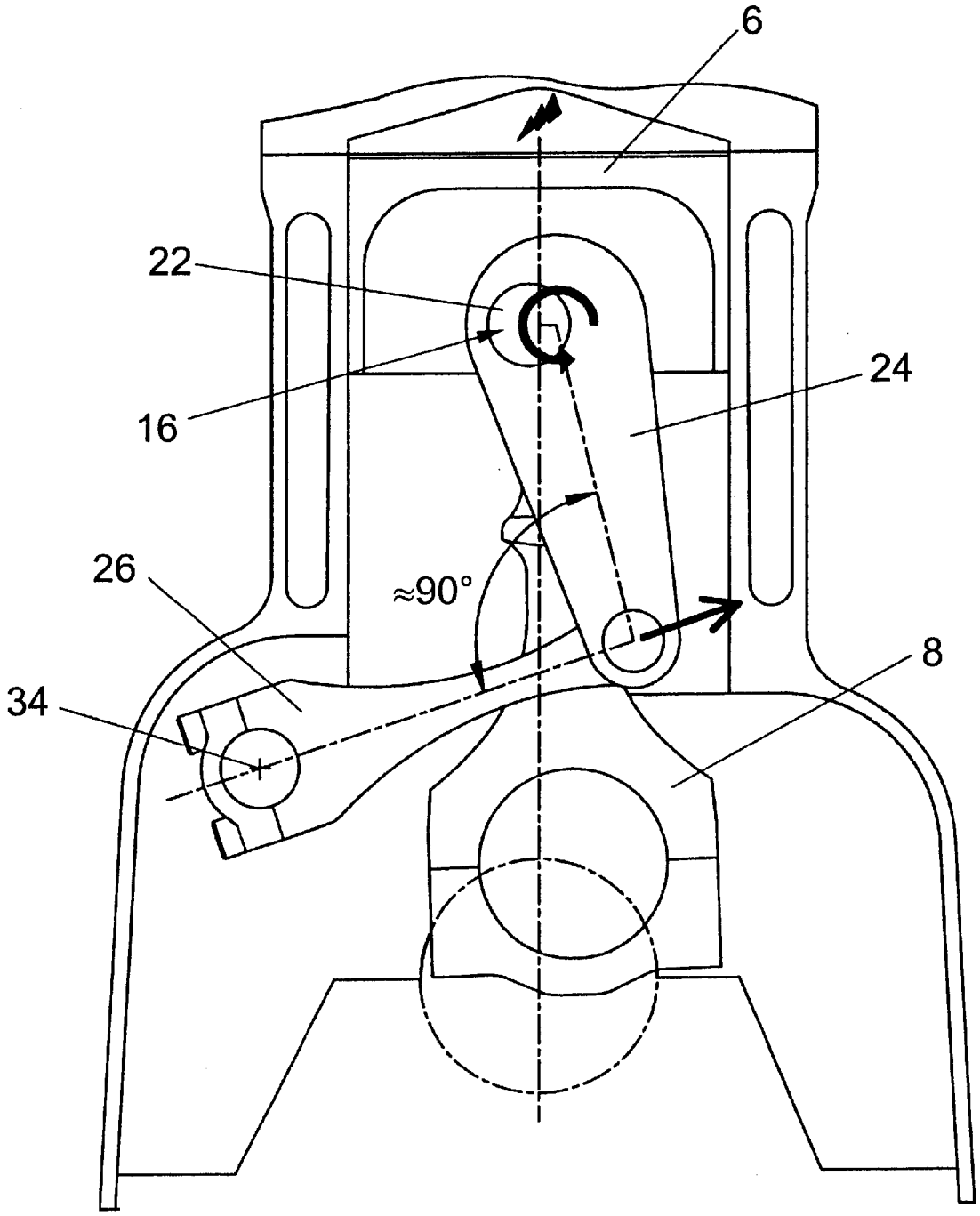
FIG. 13 is an illustration for explaining an advantageous geometrical relationship between the piston, the eccentric, the eccentric swing component, and the position coupling.

With reference to FIG. 13, further advantageous features of the geometric arrangement of portions of the compression adjustment mechanism are explained. The position shown in FIG. 13 corresponds to the position of the adjustment bearing 34 during minimal compression (shortest possible effective length of the piston rod 8) and the disposition of the piston 6 in the top dead point. The arrangement of the eccentric swing component 24 and the position coupling 26 is thereby advantageously arranged such that the angle therebetween is approximately 90 degrees. In this manner, an optimal leverage advantage is achieved for the position coupling 26 and, thereby, the smallest loading of the linkage points.

It is further advantageous if the eccentric 16 is arranged such that a tension force is exerted on the position coupling 26 by the downwardly directed force of the piston 6, as shown in FIG. 13. This force is exerted thereon, as is seen in FIGS. 9 and 10, as long as the axis A is disposed to the right of the axis B as, in this case, a downward force directed on the axis B moves or swings the eccentric swing component 24 in a counter-clockwise direction and thereby leads to a tension force on the position coupling 26. In FIG. 13, a gas force directed downwardly on the piston 6 exerts a moment on the eccentric swing component 24 which is depicted by the arcuate arrow in the vicinity of the eccentric 16. The resulting tension force acting on the position coupling is shown by the thick arrow extending in the length direction of the position coupling. It is important that the position coupling 26, especially in the top dead point of the piston 6 and during minimal compression (full charge), has a tension force exerted thereon, as this can produce the greatest force. The tension force exerted on the position coupling makes possible its weight-optimized configuration.

Figure 14:
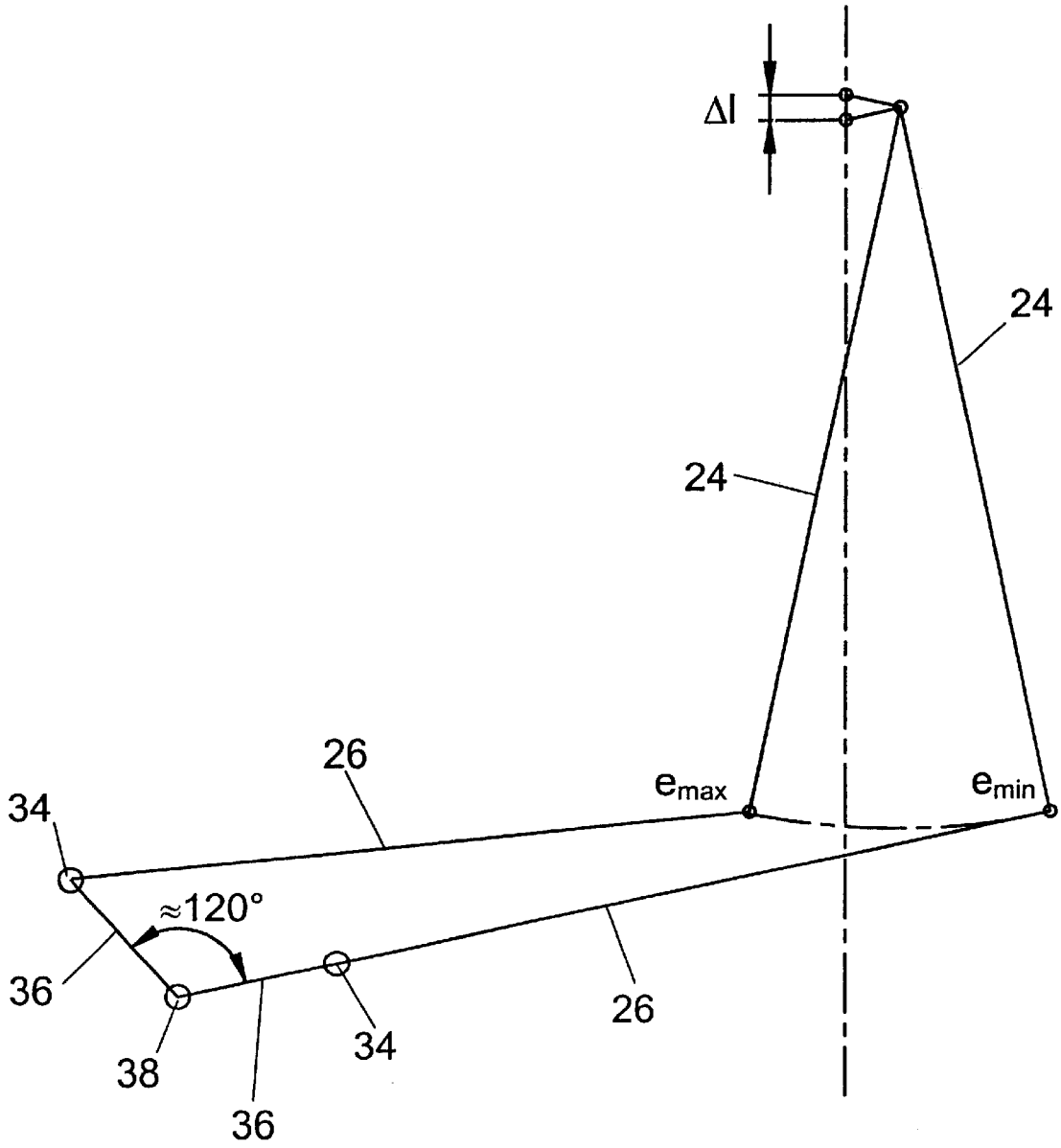
FIG. 14 is an illustration for explaining an advantageous geometric arrangement between a crankshaft, the position coupling, and the eccentric swing component.

FIG. 14 shows an advantageous kinematic configuration of the position shaft 36 (FIG. 6) in connection with the position coupling 26 and the eccentric swing component 24. The maximum compression (greatest effective piston rod length) in this position is designated, in the top dead point of the piston stroke, as $e_{max}$. The minimum compression in the top dead point of the piston stroke in this position is designated as $e_{min}$. It is advantageous if the shaft 38 or, respectively, its position shaft 36, cooperatively operates with the position coupling 26 such that, in the designated $e_{min}$ position, an extension position or, respectively, a dead point position of the piston results. The required positional moment on the shaft 38 is then at a minimum. In the illustrated example, the swing angle of the position coupling 26 is approximately 120° and, preferably, 180°, as thereafter a second spacing or, respectively, dead point position, results.

Figure 15:
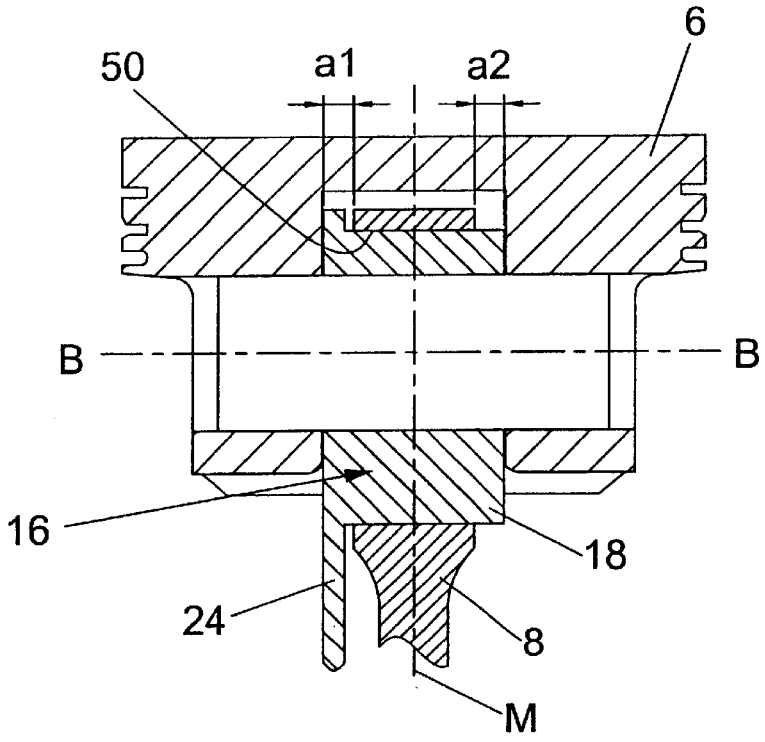
FIG. 15 is a view through the eccentric showing piston bolts, the piston rod, and the eccentric swing component.

FIG. 15 shows an advantageous arrangement of the bearing position of the piston rod 8 on the eccentric. The eccentric 16 is configured in the form of a disk 18 on whose side the eccentric swing component 24 is unitarily formed therewith as an integrated unitary piece or is fixably secured thereto. The disk 18 has an arcuate, or respectively, cylindrical, annular circumference 50, which forms the bearing surface for the piston rod 8. The piston bolt is disposed eccentrically on the disk 18 and has an axis B. As shown, the arrangement is such that the piston rod 8, as viewed with respect to its axial position, is arranged symmetrical to the piston mid plane M. This is achieved in that the axial distances Al and A2 between the back ends of the piston rod 8 and the back end of the eccentric 16 are of the same size. In the described arrangement, the piston rod 8 is substantially free from bending moments about an axis perpendicular to the axis B and is symmetrically loaded with respect to the piston.

Figure 16:
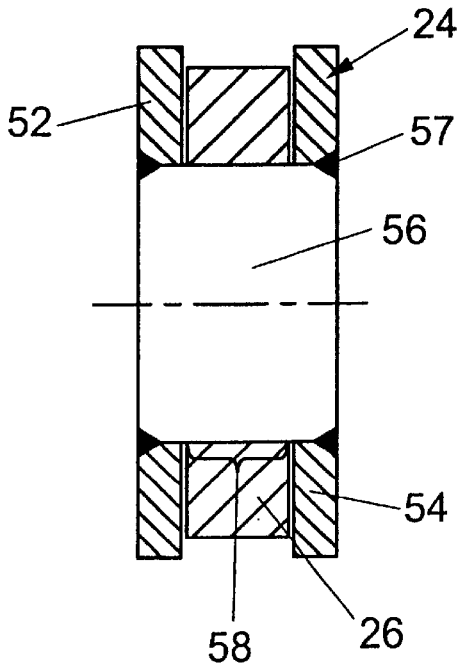
FIGS. 16 and 17 are views of two embodiments of the position of the eccentric swing component on the position coupling.

FIG. 16 shows an embodiment of the linkage between the eccentric swing component 24 and the position coupling 26. The eccentric swing component 24 terminates in a fork having two arms 52 and 54 which are configured with a through bore. The position coupling 26 received between the arms 52 and 54 compromises as well a through bore. A hardened and polished bearing bolt 56 extends through the through bores and is fixably connected to the eccentric swing component 34 at 57 by caulking, press fitting, or otherwise. The bearing 58 is, in this manner, formed thereby through the inner circumferential surface of the through bores of the position coupling 26 and the corresponding outer surface of the bearing bolt 56. The linkage has a short axial displacement requirement and exploits the available surfaces for a minimum surface pressure.

Figure 17:
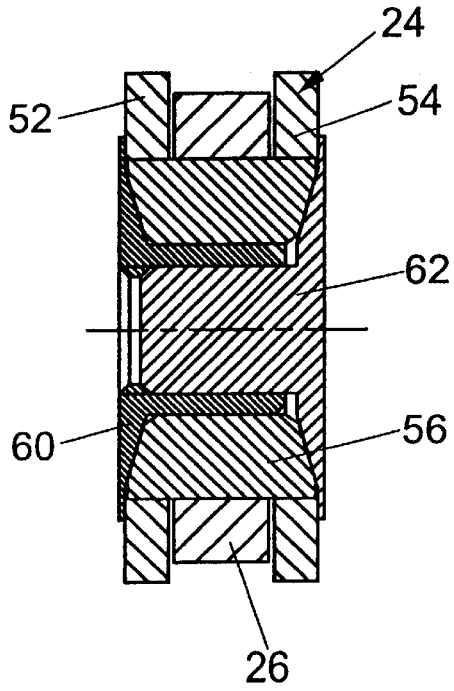
Figure 18:
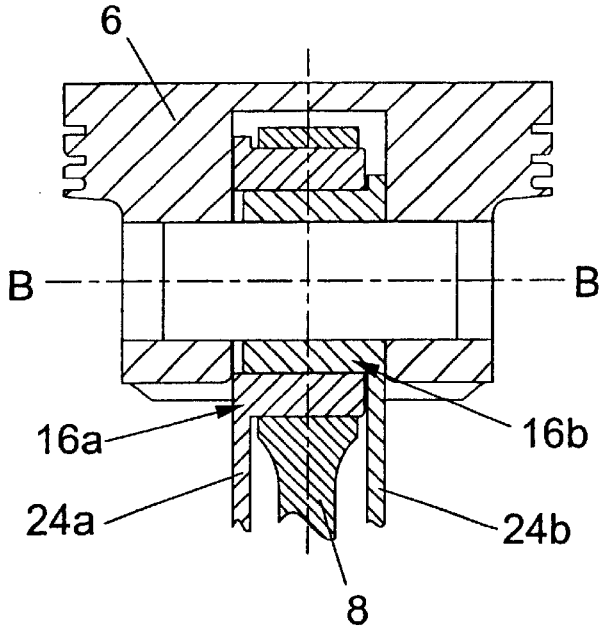
FIGS. 18 through 21 are schematic illustrations of a double eccentric arrangement.
Figure 19:
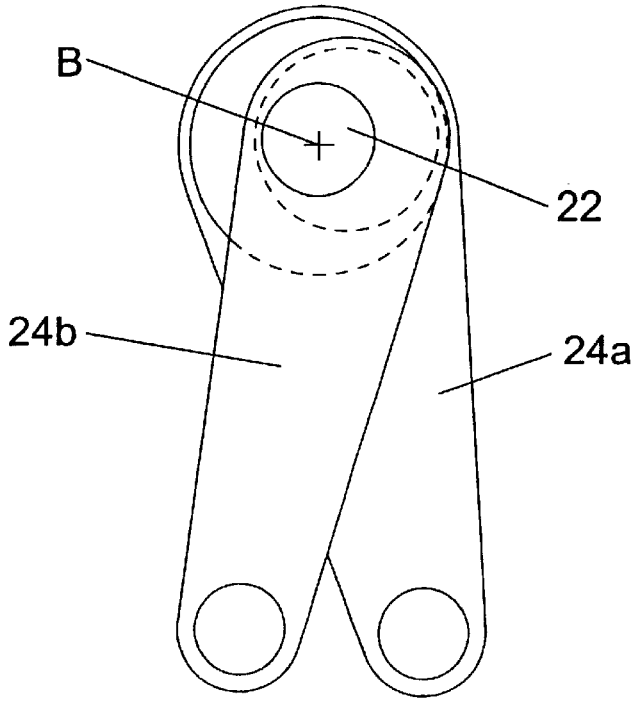

FIG. 17 shows an embodiment of the linkage connection in which the bearing bolt 56 is not directly fixedly connected with the eccentric swing component 24 nor connected thereto via a material interconnection. A threaded tube 60 is disposed in a through bore of the bearing bolt, the outer circumference of the threaded tube corresponding to the inner circumference or periphery of the through bore. The threaded tube 60 includes an inner threaded portion which is threadingly engaged by an outer threaded portion of a screw 62. The threaded tube 60 and the screw 62 each comprise respective conical surfaces at the heads thereof which cooperate together with corresponding conical surfaces of the bearing bolt 56, whereby the heads of the threaded tube 60 and the screw 62 extend in radial overlapping manner over the bearing bolt 56. The linkage connection in accordance with the arrangement in FIG. 17 achieves the same advantages as the arrangement shown in FIG. 16. The linkage shown in FIG. 17 is, however, detachable.

With reference to FIGS. 18–21, a double eccentric arrangement is hereinafter described. As can be especially seen in FIG. 18, a first eccentric 16*a* is mounted on the piston rod 8 and cooperates with an eccentric 24*a*. An additional eccentric 16*b* with an eccentric swing component 24*b* is mounted eccentrically on the eccentric 16*a*. The piston bolt 22 is eccentrically mounted in the eccentric 16*b* for pivoting about an axis B.

Figure 20:
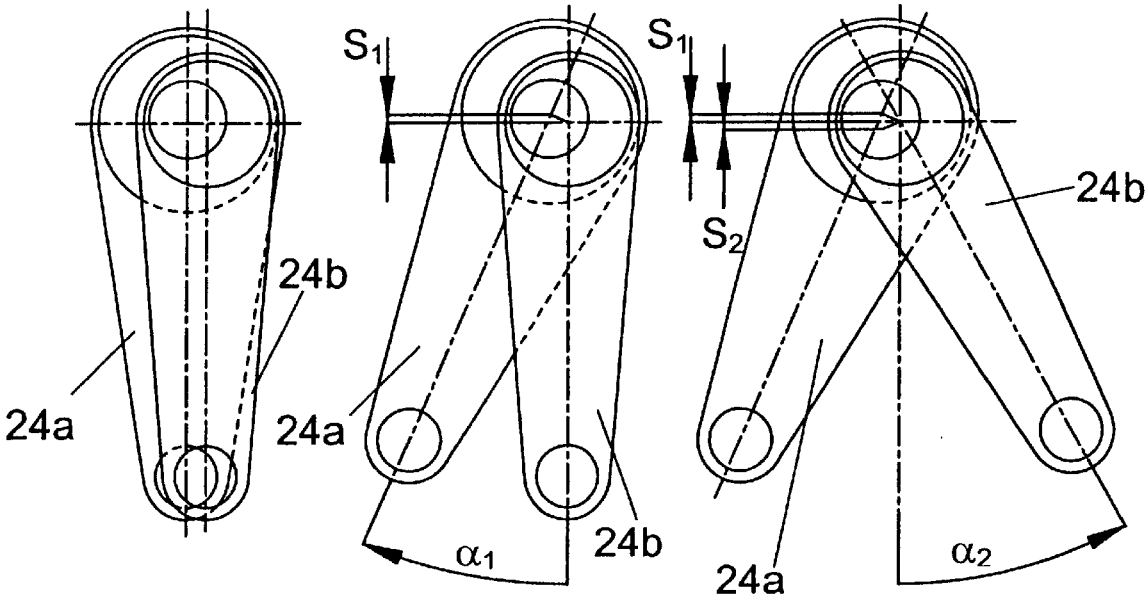

FIG. 20 shows, on the left-hand side thereof, the position of the double eccentric arrangement in which both eccentric swing components are disposed approximately in a vertical position. If the eccentric swing component 24*a* is swung out of the vertical position through an angle Δ1 in the clockwise direction α (the middle portion of FIG. 20), the axis B is lowered by an amount $S_1$. If, additionally, the eccentric swing component 24*b* is swung through an angle α2 in a counter-clockwise direction, the axis B is lowered by an additional amount $S_2$. In this manner, the effective piston rod length is shortened by an amount equal to the spacing $S_1+S_2$. In an oppositely oriented adjustment of the eccentrics, there follows an oppositely oriented change in the effective piston rod length.

Figure 21:
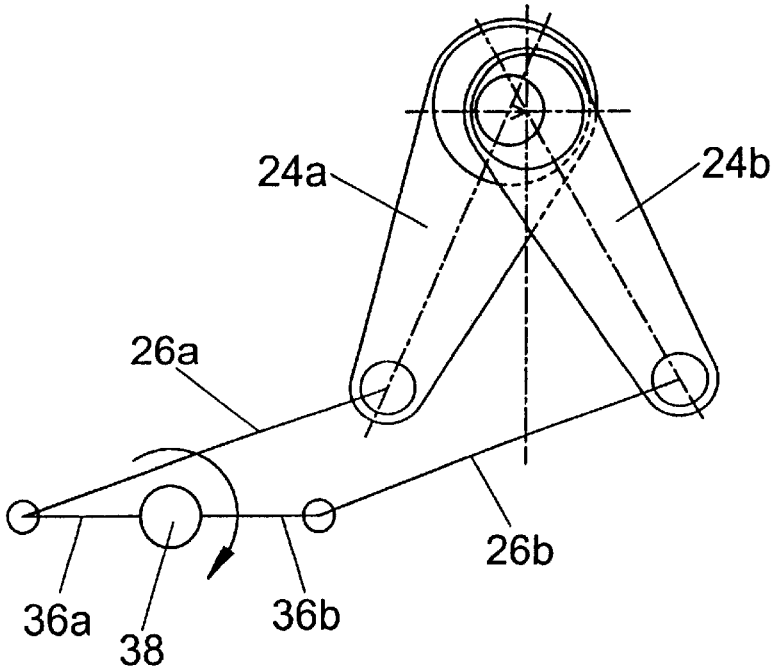

FIG. 21 shows how the eccentrics 24*a* and 24*b* are connected with a shaft 38 via associated position couplings 26*a* and 26*b*, respectively, connected to oppositely oriented position shafts 36*a* and 36*b*, so that the eccentrics 24*a* and 24*b* are adjusted in opposed direction during a pivoting or rotation of the shaft 38. In connection with the described double eccentric arrangement, the adjustment range of the effective piston rod length and, thereby, the compression, is enlarged without instigating a need for additional component installation space.

Figure 22:
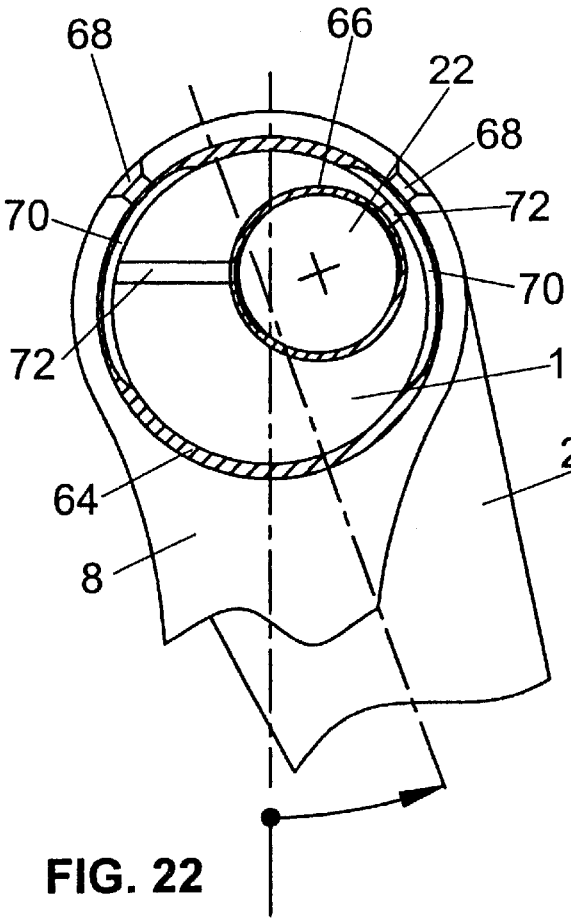
FIGS. 22 and 23 are views through an eccentric bearing and FIGS. 24 and 25 are views of two embodiments of the piston rod and the eccentric swing component.
Figure 23:
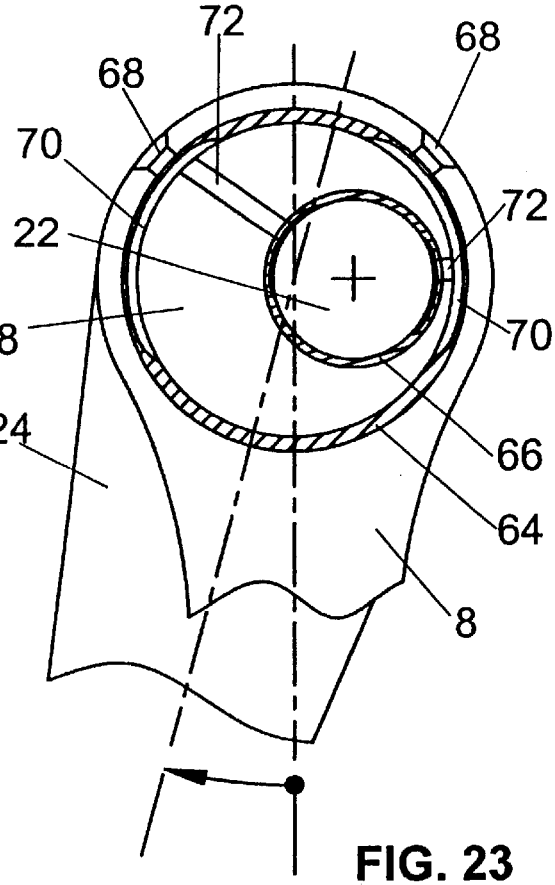

With reference to FIGS. 22 and 23, an advantageous embodiment of the eccentric bearing position is hereinafter described:

Between the piston rod 8 and the disk 18, a bearing or, respectively, a bearing bushing 64, is arranged. A further bearing bushing 66 is disposed between the disk 18 and the piston bolt 22. In order to provide for oil lubrication of the serially actuated bearing positions, an injection oil lubrication arrangement is provided which injects oil that has dropped from the piston or has been directly injected onto the piston rod 8. In this connection, the piston rod 8 is provided with passage bores 68 which extend from its outer periphery to the bearing bushing 64 and thereat communicate with an oil distributor groove 70 in the bearing bushing 64. Passage bores 72 extend from the oil distributor groove 70 to the disk 18, which leads to the bearing bushing 66. As illustrated, the oil distributor grooves 70 are dimensioned, in consideration of their circumferential length, such that they are constantly in connection with the passage bores 68 through the inner bearing bushing 66 independent of the pivot position of the disk 18 relative to the piston rod 8. It is to be understood that the bearing bushing 66 can be provided with oil distributor grooves to ensure an even further improved lubrication.

In a modified embodiment of the afore-described bearing, the bearing bushings can be omitted. The oil distributor grooves are then configured in the interior side of the piston rod 8 or on the exterior of the disk.

Figure 24:
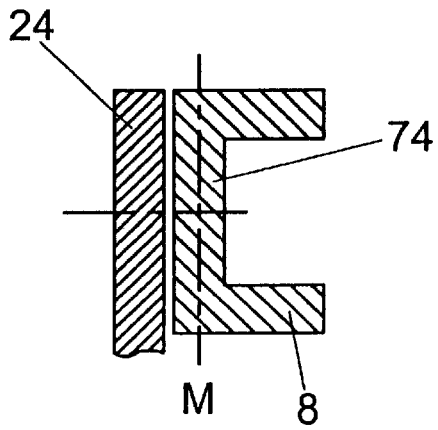
Figure 25:
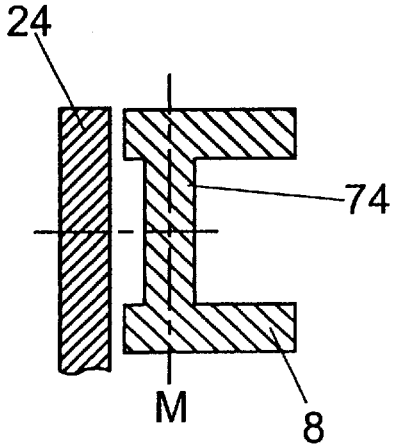

With reference to FIGS. 24 and 25, the cross-sections through a piston rod 8 and an eccentric 24 are illustrated therein and are described in the following advantageous configuration of the piston rod shaft, which is shown in sectional view. Without the otherwise adjacently located eccentric, the piston rod shaft is otherwise symmetric to the mid plane M of the piston. As a result of the one-sided arrangement of the eccentric swing component 24, the space relationship for the piston rod shaft is non-symmetrical. In order that the piston rod, despite the one-sided shrinkage of space for the piston rod shaft, can nonetheless receive the high charging load, the profile of the piston rod shaft is changed as shown, for example, in FIGS. 23 and 24. In both events, the piston rod shaft includes a middle bar 74 which lies in the piston mid plane M. In the operational position shown in FIG. 24, the cross-section of the piston rod shaft has an overall U-shape. In the configuration shown in FIG. 25, the cross-section of the piston rod shaft has a double T shape, whereby the cap legs of the T are of unequal lengths relative to one another. A torsional stiff and fully loadable piston rod structure is obtained with both piston rod shaft profiles.

Numerous advantages can be achieved with the adjustment of the compression relationship in accordance with the present invention, whereby several of these advantages are given in an exemplary manner hereafter:

During cold starting or partial charging of the piston engine, an increase in the compression provides the advantage of the reduced cyclic fluctuations and leads thereby to a more comfortable motor vehicle running operation. During partial charging, a compression increase leads to reduced fuel usage and an improved inert gas tolerance. Also, during full charging, the fuel usage decreases due to a compression tailored to provide a favorable distance with respect to the knock limit and provides thereby a good tolerance for exhaust gas counter pressures.

The pollution emissions are reduced by means of an appropriate compression in all operating conditions. During a warmed up operational phase, the exhaust gas temperature is, additionally, increased, which results in a more rapid heating up of the catalyzer.

Charged or loaded motors can be operated, by compressions appropriately tailored thereto, through all load and rotation operational scenarios in a more economical manner, whereby the fuel charge grade is increased and, during full charging or loading, a sufficient distance from the knock limit is possible, whereby a lubrication operation can be dispensed with.

Diesel Motor:

The required compression relationship for a cold start is accommodated in all other operational conditions to the respective optimization parameters. The goal conflict between $NO_x$ and particles can be reduced. The inert gas tolerance is improved. The mechanical loading of the drive train and the swing or fluctuation movements are minimized. The load grade or capacity can be increased.

The specification incorporates by reference the disclosure of German priority documents 100 26 634.7-13 filed May 29, 2000 and 100 58 206.0-13 filed Nov. 23, 2000 as well as European priority document PCT/EP01/05956 filed May 23, 2001. The present invention is, of course, in no way restricted to the specific disclosure of the specification and drawings, but also encompasses any modifications within the scope of the appended claims.

What is claimed is:

1. An apparatus for changing the compression in a cylinder of a piston engine, the piston engine having a piston and a piston rod, one end of which is secured to the piston and an opposite end of which is secured to a crankshaft, comprising:

an eccentric for eccentrically mounting the one end of the piston rod to the piston, the eccentric being pivotable about a pivot axis;

an eccentric swing component secured to the eccentric;

a linkage assembly connected to the eccentric swing component for controlling the swing movement of the eccentric swing component to follow a predetermined path such that an angular pivoting movement of the eccentric about its pivot axis is a function of the swing movement of the eccentric swing component, whereby an adjustment of the swing movement of the eccentric swing component effects a change in the angular pivoting movement of the eccentric and, thus, a corresponding change in the compression in the cylinder created by the relationship of the piston and the cylinder to one another, the linkage assembly including a position coupling moveably mounted at one end to the eccentric swing component and at another end to a position coupling securement element such that the position coupling guides the eccentric swing component to swing through a predetermined swing movement during stroke movement of the piston; and a guide assembly for guiding the movement of a selected one of the eccentric swing component and the position coupling along a predetermined path during its respective movement during a piston stroke, the guide assembly including one cooperative element mounted to the respective one of the eccentric swing component and the position coupling and another cooperative element mounted to another component of the piston engine, the cooperative elements moving relative to one another during a piston stroke and cooperating with another to guide the movement of the respective one of the eccentric swing component and the position coupling along the predetermined path.

2. An apparatus according to claim 1, wherein the guide assembly includes an engagement portion between the piston rod and the eccentric swing component.

3. An apparatus according to claim 1, wherein the guide assembly comprises a slide guide portion fixably secured to the motor housing for guiding the position coupling.

4. An apparatus according to claim 3, wherein the position coupling, which effects a swing movement of the eccentric swing component, is connected to the eccentric swing component in a manner such that the rotative position of the eccentric swing component relative to the movement direction of the piston is substantially maintained during a stroke movement of the piston.

5. An apparatus according to claim 4, wherein the position coupling is arranged such that, during a stroke movement of the piston, the position coupling is swung back and forth in a movement approximately perpendicular to the movement direction of the piston, and the adjustment bearing, to effect a change in the compression, is adjustable generally perpendicular to the movement direction of the piston.

6. An apparatus according to claim 4, wherein the piston engine comprises a plurality of cylinders with pistons, on which the associated piston rods are mounted via an eccentric, and an adjustment apparatus is provided by which the rotative position of the eccentric of various pistons can be simultaneously changed.

7. An apparatus according to claim 1, wherein the longitudinal axis B of a piston bolt extending through the eccentric is offset in a direction outwardly of the mid plane M of the piston, and the axis A of the rotational mounting of the piston rod with the eccentric is offset in a direction opposite to that of the axis B of the piston bolt.

8. An apparatus according to claim 1, wherein, at a position of the eccentric swing component in which the eccentric swing component is parallel to the mid plane of the piston, the axis A of the rotational mounting of the piston rod with the eccentric, relative to the longitudinal axis B of a piston bolt extending through the eccentric, extends perpendicularly to the mid plane M of the piston and is offset in the direction toward the crankshaft of the piston engine.

9. An apparatus according to claim 1, wherein the arrangement of the eccentric, the eccentric swing component, and the position coupling is such that the piston, under the force of gas thereagainst, imparts a tension force on the position coupling.

10. An apparatus according to claim 1, wherein the arrangement of the eccentric, the eccentric swing component, and the position coupling is such that the eccentric swing component and the position coupling, during a minimal compression at the top dead point of the piston, form therebetween an angle of approximately 90°.

11. An apparatus according to claim 1, wherein the position assembly comprises a position shaft which, at least in the position of the minimum compression, assumes a dead point position.

12. An apparatus according to claim 1, wherein the eccentric is formed by a disk disposed on the side of the eccentric swing component and having an annular shape, through which the piston bolt extends in an off center orientation and wherein the axial arrangement of the outer circumference of the disk is configured such that the longitudinal extent of the piston rod which is mounted to the disk extends at least approximately within a middle plane of the piston.

13. An apparatus according to claim 1, and further comprising two eccentrics each having a respective eccentric swing component fixably secured thereto and the eccentrics cooperatively engaging one another and one of the eccentrics being mounted to the piston rod and the other being mounted to the piston bolt and each eccentric being disposed relative to a position coupling and each eccentric swing component being secured to a respective position coupling, the movement of the position couplings during an adjustment of the position assembly effecting movement of the eccentric swing components in substantially opposite directions.

14. An apparatus according to claim 1, wherein the eccentric arrangement is provided with bearing bushings which comprise oil distributor grooves which are supplied with a lubricating oil via bores in the piston rod and the eccentric.

15. An apparatus according to claim 1, wherein the piston rod has a cross-section in profile which includes a middle bar which lies in the mid plane of the piston.

* * * * *